United States Patent [19]

Hannouche

[11] 4,431,232

[45] Feb. 14, 1984

[54] BACK CUSHION

[76] Inventor: Nabil Hannouche, 403 Andulusian Trail, Simpsonville, S.C. 29681

[21] Appl. No.: 188,336

[22] Filed: Sep. 18, 1980

[51] Int. Cl.[3] ..... A47C 7/02

[52] U.S. Cl. ..... 297/460; 5/432; 297/284

[58] Field of Search ..... 5/432, 433; 297/460, 297/284, DIG. 1

[56] References Cited

U.S. PATENT DOCUMENTS

| | | | |
|---|---|---|---|
| 1,667,626 | 3/1927 | Epstein . | |
| 1,673,433 | 10/1927 | Wheeler et al. . | |
| 1,898,272 | 2/1933 | Stern | 5/432 |
| 1,935,685 | 11/1933 | White . | |
| 1,937,920 | 12/1933 | Smith . | |
| 1,975,586 | 10/1934 | Law . | |
| 2,081,111 | 5/1937 | Manley . | |
| 2,188,421 | 1/1940 | Wade . | |
| 2,291,266 | 7/1942 | Wade . | |
| 3,041,108 | 6/1962 | Cohn . | |
| 3,288,525 | 11/1966 | Cerf | 297/460 X |
| 3,361,471 | 1/1968 | Radford | 297/460 X |
| 3,716,875 | 2/1973 | Fehr | 297/DIG. 1 |
| 4,105,249 | 8/1978 | Van Vliet, Jr. | 297/230 |

FOREIGN PATENT DOCUMENTS

| | | | |
|---|---|---|---|
| 957440 | 11/1974 | Canada | 5/432 |
| 483328 | 2/1970 | Switzerland | 297/460 |

*Primary Examiner*—James T. McCall

*Attorney, Agent, or Firm*—Bailey & Hardaway

[57] ABSTRACT

A cushion for engaging the small of the back when the user is in a seated position has a generally planar base portion for engaging a seat back and a generally arc-shaped small of the back engaging portion with dorsal and sacral engaging sections thereon. The back cushion minimizes tension and provides proper curvature for the small of the back section of the spine.

3 Claims, 3 Drawing Figures

FIG. 1
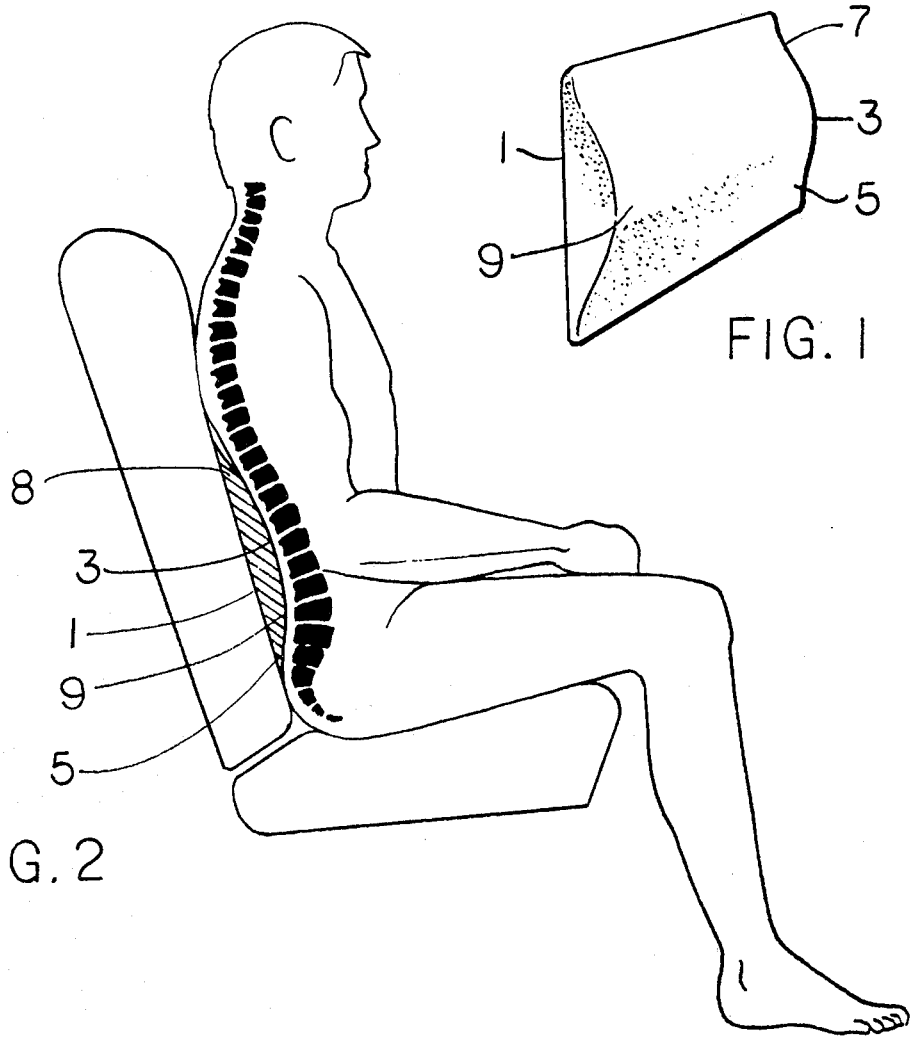
FIG. 2
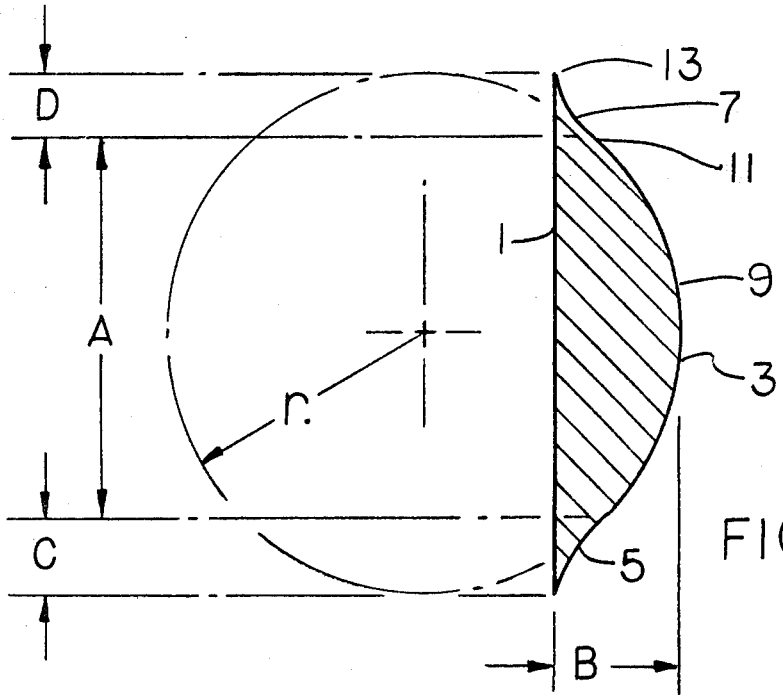
FIG. 3

BACK CUSHION

BACKGROUND OF THE INVENTION

This invention relates generally to the art of back cushions and more particularly to the art of a back cushion adapted to minimize unnatural curvature of the spinal section between the sacral and dorsal areas of the spine.

Many prior art devices have attempted to provide for increased comfort within the small of the back portion of a human being in the sitting position. Many such devices are described within prior patents.

One such spinal support is described in U.S. Pat. No. 1,667,626 to Epstein. The spinal support described therein comprises a cushion having a back engaging portion substantially of a constant curvature and comprises handles for suspending the spinal support in an appropriate position from the top of a chair back.

Another such pad for a chair or seat back is described in U.S. Pat. No. 1,937,920 to Smith. Smith describes a support which extends from the seat area behind the buttocks of the sitting person into the small of the back. The back area within the small of the back is engaged by a surface of substantially constant curvature. The pad is adapted to be inverted to accommodate various size persons with the pad being positioned and retained upon the chair seat.

Another such back rest is described in U.S. Pat. No. 1,975,586 to Law. The back rest described therein is intended for use within a moving vehicle, such as automobiles and trains. The pillow is adapted for the circulation of air so as to minimize the accumulation of heat between the pillow and the user. The back rest is generally elliptical and is useful as a head cushion as well as a back rest.

While many such back rests or supports have been available within the prior art, no back rest device has been totally satisfactory for the proper positioning of the spine so as to minimize tension and unnatural curvature which may be caused by excessively long periods within such a sitting position and vibrations which may accompany transportation in a moving vehicle.

SUMMARY OF THE INVENTION

It is thus an object of this invention to provide a cushion for engaging the small of the back so as to minimize tension and unnatural curvature when in the sitting position.

It is a still further object of this invention to provide such a cushion which is adaptable for use by various sized individuals without sacrificing the proper positioning of the back engaging portion.

These as well as other objects are accomplished by a cushion for engaging the small of the back having a generally planar base portion, and a generally arc-shaped small of the back engaging portion with dorsal and sacral engaging sections thereon.

BRIEF DESCRIPTION OF THE DRAWINGS

FIG. 1 is an oblique view of a cushion in accordance with this invention.

FIG. 2 of the drawing illustrates the cushion of this invention in cross section as it is lodged between a seat back and the spine of the user.

FIG. 3 of the drawing illustrates the surface geometry of a cross section of the cushion in accordance with this invention.

DETAILED DESCRIPTION

As used within this disclosure, the term "small of the back" includes that section of the spinal column extending from the sacral region through the lumbar region and into transition of the dorsal region. The cushion in accordance with this invention is adapted for engaging the small of the back between that section of the spinal column and a seat back when the user is in the sitting position so as to prevent unnatural curvature within the small of the back section of the spine and to prevent tension within that section of the spine during prolonged periods in the sitting position.

FIG. 1 of the drawings illustrates an oblique view of a cushion in accordance with this invention. The cushion has a generally planar base portion 1 merging with a generally arc-shaped small of the back engaging portion 3. The back engaging portion comprises a sacral engaging section 5 and a dorsal engaging section 7. Both the sacral engaging section 5 and dorsal engaging section 7 merge with the generally planar base portion 1 to define the upper and lower limits of the cushion. The arc-shaped back engaging portion 3 comprises between the dorsal engaging section 7 and sacral engaging section 5 a central section 9 of substantially constant curvature.

FIG. 2 of the drawing illustrates in cross section the use of the cushion in cooperation with the spinal column and a seat back. As is shown in FIG. 2, proper spinal curvature is maintained when the cushion of this invention is lodged between the spinal column and a seat back. The curvature of the generally arc-shaped small of the back engaging portion of this invention is best illustrated in FIG. 3 of the drawings, wherein the geometrical configuration is illustrated.

As is shown in FIG. 3, the central section 9 of the generally arc-shaped small of the back engaging portion extends through the dimension "A" at a constant radius "r". The dimension "A" within the concept of this invention may comprise up to 75 percent of the overall height of the generally planar portion 1. The dorsal engaging section 7 and sacral engaging section 5 are preferably of equal dimensions c and d, but both may be varied from about 12 to about 20 percent of the height of base section 1. The variation in curvature within the dorsal and sacral engaging is readily illustrated in FIG. 3 of the drawing.

Within the sacral engaging portion 5 the radius expands from the substantially constant radius within the central section to a gradual tapering to merge with the generally planar base portion 1.

Within the dorsal section 7 the radius varies initially from the transition point 11 to a radius of less than the substantially constant radius "r" and then expands to a greater radius at the point of merger with the generally planar base portion 1. The section of reduced radius between the point of transition 11 and merger with base portion 1 at point 13 produces a concavity in the otherwise generally convex surface of the generally arc-shaped small of the back engaging portion 3. The dorsal engaging section 7 is designed with appropriate curvature to conform the transition from the lumbar region of the spinal column into the dorsal region, wherein the natural curvature of the spine changes the direction of its radius.

In actual use as is illustrated in FIG. 2 of the drawings, the cushion of this invention is lodged between the spine and the seat back. The sacral engaging section does not reside behind the buttocks and does not contact the seat bottom. The entire cushion is trapped between the spine and the seat back so as to provide for support within the small of the back regardless of the distance between the seat and the small of the back of the individual user. The more preferred use of the cushion in accordance with this invention is within an automobile where lengthy trips normally severely fatigue the spine and cause unnatural curvature thereof and accompanying ailments. During extended travel the support provided by the cushion so as to maintain the normal curvature of the spine prevents tension within that area as well as providing the support to maintain a natural curvature.

As many of the dimensions within the cushion of this invention are significant parameters to the maintenance of proper spinal curvature when in a sitting position such dimensions are given herewith. The radius "r" is preferably approximately 15 centimeters. The dimension for the height of the planar base (a+c+d) is also 30 centimeters. The dimension "A" is 20 centimeters, with the dimensions "C" and "D" being preferably 5 centimeters each. The dimension "B" is 9 centimeters. Such dimensions are given for purposes of illustrating the preferred construction, and are not to be construed as limiting in nature. Such dimensions may be significantly varied but are within the scope of this invention as long as the cushion adapts and conforms to the curvature of the spine as taught herein. For example, the substantially constant radius may be varied within the range of 11 to 17 centimeters in order to provide various size cushions for various size individuals.

Conventional foam rubber is the preferred material of construction in accordance with this invention. However, such foam rubber may be reinforced with metallic or a wire like reinforcement in order to provide enhanced rigidity. Additionally the cushion may have embedded therein or a cover thereon which includes heating means to provide therapeutic heat when the cushion is in use. The cushion may be covered with any desired fabric or covering material. For example, when used within an automobile, the cushion may be covered with a fabric keyed to complement or blend with the fabric or upholstery within the automobile.

Preferably the cushion in accordance with this invention is of a length to permit use by only a single individual. Such a length is generally approximately 30 centimeters. It is envisioned, however, that a length of substantially the width of an automobile bench seat may be utilized and have sufficient flexibility to permit adjustment between passengers.

It is thus seen that the cushion in accordance with this invention provides support for the small of the back for a user in the seated position and maintains proper spinal curvature for the user during prolonged periods within the seated position. It is additionally seen that the cushion in accordance with this invention minimizes tension and unnatural curvature within the small of the back and provides critical curvature necessary to the maintenance of natural spinal curvature. As many variations will be apparent to those of skill in the art from a reading of the above specification which is exemplary in nature, such variations are included within the spirit and scope of this invention as is measured by the following appended claims.

That which is claimed is:

1. A cushion adapted to engage the small of the back of a human being when in the sitting position comprising:

a generally planar base portion;

a generally arc-shaped small of the back engaging portion merging with said base portion, said arc-shaped back engaging portion having an arc with a substantially constant radius of curvature of from 11 to 17 centimeters within its central section of up to 75 percent of the length of the base portion for lumbar engagement, said back engaging portion having a sacral engaging section between said central portion and said base portion which tapers from said arc of a substantially constant radius toward said base portion at a radius greater than said substantially constant radius, and a dorsal engaging section between said central portion and said base portion, said dorsal engaging section varying from a radius at said central portion which is less than said substantially constant radius to a radius which is greater than said substantially constant radius at the point of merging with said base portion, and wherein said sacral engaging section does not extend to the buttock area during use; and wherein said dorsal engaging section and said sacral engaging section are substantially of equal length and comprise from twelve (12) to twenty (20) percent each of the length of the base portion.

2. The cushion in accordance with claim 1 wherein said cushion is constructed of a foam rubber.

3. The cushion in accordance with claim 1 wherein said cushion comprises foam rubber with metallic reinforcement embedded therein.

* * * * *